US009174713B2

(12) United States Patent
Item et al.

(10) Patent No.: US 9,174,713 B2
(45) Date of Patent: Nov. 3, 2015

(54) UNMANNED UNDERWATER VEHICLE

(71) Applicant: Raytheon Company, Waltham, MA (US)

(72) Inventors: Erik F. Item, Waltham, MA (US); Mark S. Langelier, Waltham, MA (US); Curtis B. Carlsten, Waltham, MA (US); Daniel B. Minarik, Waltham, MA (US)

(73) Assignee: Raytheon Company, Waltham, MA (US)

( * ) Notice: Subject to any disclaimer, the term of this patent is extended or adjusted under 35 U.S.C. 154(b) by 224 days.

(21) Appl. No.: 13/667,505

(22) Filed: Nov. 2, 2012

(65) Prior Publication Data

US 2014/0213126 A1 Jul. 31, 2014

(51) Int. Cl.

| | |
|---|---|
| ***B63G 8/00*** | (2006.01) |
| ***B63G 8/08*** | (2006.01) |
| ***B63C 11/42*** | (2006.01) |

(52) U.S. Cl.

CPC . *B63G 8/08* (2013.01); *B63C 11/42* (2013.01); *B63G 8/001* (2013.01)

(58) Field of Classification Search

USPC ..... 114/337, 151; 440/42
IPC ..... B63H 25/42,25/46; B63G 8/08
See application file for complete search history.

(56) References Cited

U.S. PATENT DOCUMENTS

| | | | | |
|---|---|---|---|---|
| 2,963,543 | A * | 12/1960 | Link et al. | 348/81 |
| 5,045,004 | A * | 9/1991 | Kim | 440/45 |
| 5,574,246 | A * | 11/1996 | Meyers et al. | 114/20.2 |
| 5,704,309 | A * | 1/1998 | Kohnen | 114/312 |
| 6,581,537 | B2 * | 6/2003 | McBride et al. | 114/312 |
| 6,932,013 | B1 | 8/2005 | Shen et al. | |
| 7,124,698 | B1 | 10/2006 | Shen et al. | |
| 2002/0178990 | A1 | 12/2002 | McBride et al. | |
| 2004/0253885 | A1 * | 12/2004 | Westhoff et al. | 440/40 |

FOREIGN PATENT DOCUMENTS

| | | |
|---|---|---|
| GB | 15718 A A.D. 1915 | 3/1919 |
| WO | WO 03/059734 A1 | 7/2003 |

OTHER PUBLICATIONS

PCT Application PCT/US2013/068099; filing date Nov. 1, 2013; Raytheon Company; international search report mailed Jul. 7, 2014.

BAE Systems; Archerfish Single-shot mine disposal system; Brochure; upon knowledge and belief prior to May 7, 2012; 2 pages; BAE Systems Maritime Services.

(Continued)

*Primary Examiner* — Stephen Avila

(57) ABSTRACT

An unmanned underwater vehicle (UUV) is disclosed. The UUV includes a body and a propulsion system for propelling and orienting the UUV. The propulsion system has an inlet formed in the body that facilitates fluid being drawn into the UUV from outside the body. The propulsion system also has a duct in fluid communication with the inlet. The duct is adapted to direct the fluid along a flow path. The propulsion system further includes a pump operable with the duct to increase the velocity of the fluid. In addition, the propulsion system includes a nozzle in fluid communication with the duct to receive the fluid at the increased velocity. The nozzle is supported about a side of the body and adapted to moveably redirect fluid out of the UUV. The propulsion system provides multi-axis control of the UUV.

20 Claims, 5 Drawing Sheets

(56) References Cited

OTHER PUBLICATIONS

Hydroid; Vehicles—REMUS 100 Specifications; http://www.hydoidinc.com/100spec.html ; Mar. 18, 2011; 3 pages; Hydroid LLC.
SeaBotix; Products, LBV200-4; Vehicle—Key Features, Specifications, System Controls, Options https://web.archive.org/web/20111129081839/http://www.seabotix.com/products/lbv200-4html ; archived online Nov. 29, 2011; 9 pages; SeaBotix Inc.
Ultra Electronics; Seafox Mine Disposal System; http://www.idexuae.ae/ExhibitorLibrary/2056/SEAFOX_2.pdf ; upon knowledge and belief prior to May 7, 2012; 2 pages; Ultra Electronics Limited.

* cited by examiner

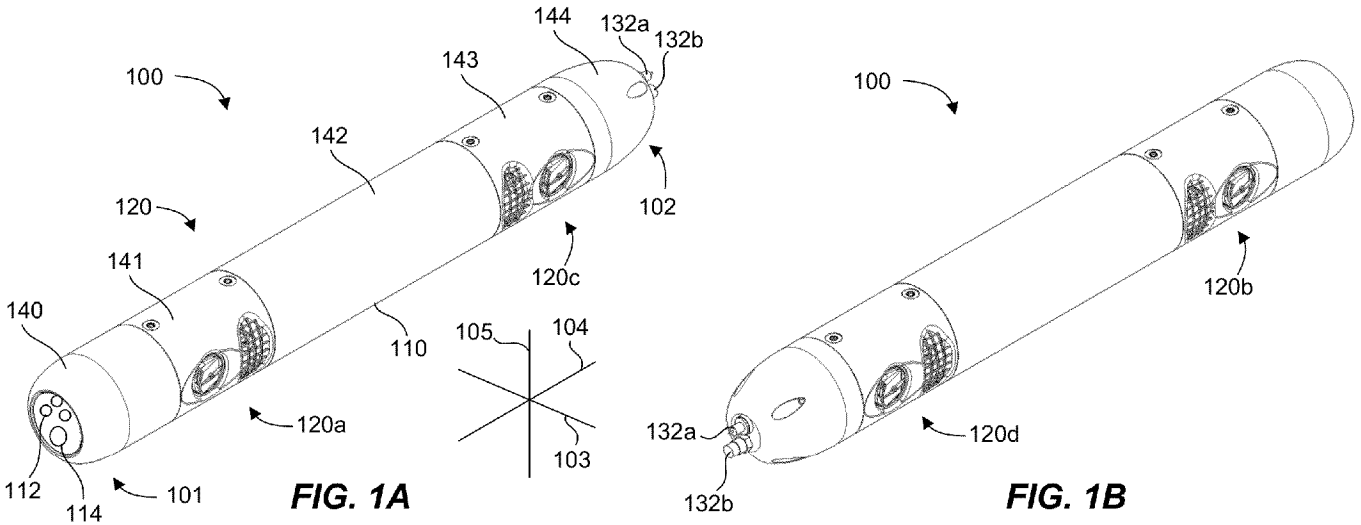
FIG. 1A
FIG. 1B
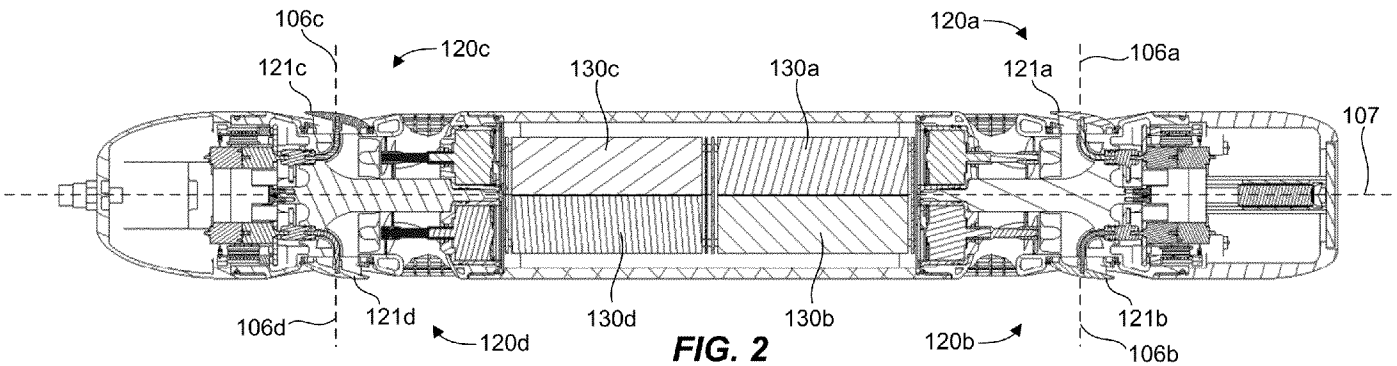
FIG. 2

UNMANNED UNDERWATER VEHICLE

BACKGROUND

A typical unmanned underwater vehicle (UUV) design includes a standard external rear propeller for propulsion, and fins or other control surfaces adjacent to the propeller that can be angled to enable guidance or orientation of the vehicle. Such vehicles are used for a variety of purposes and can include cameras or other sensors to provide information about underwater objects. For example, UUVs are commonly used in mine warfare to inspect and/or identify mines or other underwater items.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein:

FIG. 1A is a front perspective view of a UUV in accordance with an embodiment of the present invention.

FIG. 1B is a rear perspective view of the UUV of FIG. 1A.

FIG. 2 is a cross-sectional view of the UUV of FIG. 1A.

Figure 3:
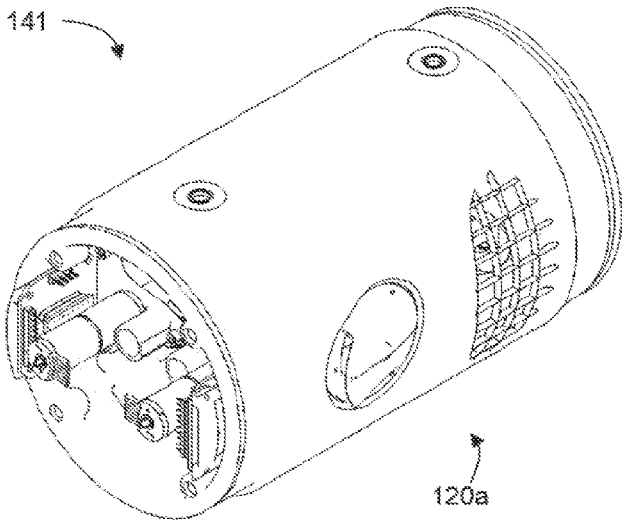
FIG. 3 is an example illustration of a propulsion module of the UUV of FIG. 1A.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected.

Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although adequate for many applications, the typical propulsion design of conventional unmanned underwater vehicles (UUV or UUVs) is only able to provide limited maneuverability of the UUV. This leaves much to be desired for applications that can benefit from precise maneuverability and/or the ability to "maintain station" or "hover," such as for inspection and/or identification of mines or other underwater items.

Accordingly, a UUV is disclosed that provides multi-axis control of the UUV and the ability to simultaneously control movement in multiple degrees of freedom. In one aspect, the multi-axis control can enable the UUV to "maintain station" even under the effects of currents or other factors tending to upset the UUV. In some exemplary embodiments, the UUV can include a body and a propulsion system for propelling and orienting the UUV. The propulsion system can comprise an inlet formed in the body that facilitates fluid (e.g., water) being drawn into the UUV from the surrounding fluid outside the body. The propulsion system can also comprise a duct in fluid communication with the inlet, the duct being adapted to direct the fluid along a flow path. Furthermore, the propulsion system can comprise a pump operable with the duct to control flow of the fluid through the duct, such as to increase the velocity of the fluid, or at least to facilitate active flow of the fluid through the duct. In addition, the propulsion system can comprise a nozzle in fluid communication with the duct to receive the fluid, the nozzle being supported about a side of the body, and adapted to moveably redirect fluid out of the UUV, which is explained in greater detail below. As such, the propulsion system can provide multi-axis control of the UUV in a manner unavailable with conventional UUVs.

A UUV is also disclosed that can include a body and a propulsion system comprising a pair of thrusters for propelling and orienting the UUV. Each thruster can comprise an inlet, a duct, a pump and a nozzle as discussed herein. The nozzles can be supported about opposite sides of the body to provide multi-axis control of the UUV.

One embodiment of a UUV 100 is illustrated in FIGS. 1A and 1B. The UUV 100 can comprise a body 110 that forms an outer structure for the UUV 100. The body 110 can be formed in a generally tubular configuration, as shown, although other configurations are possible as will be appreciated by those skilled in the art. In one aspect, the body 110 can be configured to fit within a launch tube, such as a sonobuoy tube, of a surface ship, submarine, or aircraft. The UUV 100 can also include a sensor, such as a sensor array 112 and/or a warhead 114. The sensor array 112 can include a camera, a laser, a light, GPS, sonar, an inertial measurement unit (IMU), a compass, a pressure sensor, or any other suitable sensor or related component. Sensors 112 can be used for navigating the UUV 100 and/or inspection of underwater items or features, such as mines. The warhead 114 can be used to destroy an underwater target, such as a mine, with targeting aided by the sensors 112. As illustrated in the figures, the sensors 112 and warhead 114 can be disposed in a front portion 101 of the body 110. It should be recognized that the UUV 100 can be configured to support any type of payload in or about any portion of the UUV 100.

With reference to FIG. 2, and continued reference to FIGS. 1A and 1B, the UUV 100 can also include a propulsion system 120, which can include one or more thrusters 120*a-d*, for propelling and orienting the UUV 100. The propulsion system 120, as well as other on-board components, such as the sensors 112, can be powered by one or more on-board batteries 130*a-d* disposed within the body 110. In one aspect, power and communication couplings 132*a*, 132*b* can be used to connect the UUV 100 to an external power source and/or an external control system. For example, the sensors 112 and/or propulsion system 120 can be in data communication with the external control system via a fiber optic or other communication line, which can enable remote control of the UUV 100. In one aspect, the UUV 100 can include control electronics that facilitates autonomous and/or semi-autonomous operation, such as stability controls and/or traveling to a waypoint.

The propulsion system 120 can be used to provide multi-axis control of the UUV 100 or, in other words, control in multiple degrees of freedom (DOF). For example, the thrusters 120*a-d* can direct fluid such that the UUV 100 can be movable and controllable about three translational DOF represented by axes 103, 104, 105, as well as three rotational DOF (i.e., pitch, roll, and yaw) about the axes 103, 104, 105. For example, nozzles 121*a-d* of the thrusters 120*a-d* can rotationally supported so as to rotate about axes 106*a-d*, respectfully, which can be substantially perpendicular to a longitudinal axis 107 of the body 110. Such movement of the nozzles 121*a-d* can enable multi-axis control of the UUV 100. In one aspect, the nozzles 121*a-d* can enable simultaneous movement in multiple DOF. As shown in the figures, the nozzles 121*a-d* can be countersunk into or seated within a recess formed in the body 110 to substantially maintain the overall outer surface profile of the body 110. This can facilitate disposing the UUV 100 in a launch tube without interference with the nozzles 121*a-d*.

In one aspect, the propulsion system 120 can include thrusters configured in pairs, such as thrusters 120*a-b* and 120*c-d*. In this case, the nozzles 121*a-b* of the thrusters 120*a-b* can be supported about opposite sides of the body 110 to provide and/or enhance multi-axis control of the UUV 100. The nozzles 121*c-d* of the second pair of thrusters 120*c-d* can also be supported about sides of the body 110 opposite from one another. Additionally, the pairs of thrusters 120*a-b* and 120*c-d* can also be disposed at substantially opposite ends of the UUV 100. For example, thruster pair 120*a-b* can be disposed toward the forward end 101 of the body 110 and thruster pair 120*c-d* can be disposed toward a rearward end 102 of the body 110. In this configuration, at least one thruster can be considered to be within each "quadrant" of the UUV 100 so as to provide enhanced control of the UUV in multiple DOF. It should be recognized that a propulsion system of a UUV can include any suitable number of thrusters and that the thrusters can be disposed in any suitable location within a UUV. Typically, an increased number of thrusters will provide increased stability and control the UUV in multiple DOF. As such, the discussion herein and the accompanying figures are not to be limiting in any way.

In one aspect, the UUV 100 can comprise separate modular components that can be separable from one another, and assembled to form the UUV 100. Individual modules can include, for example, a nose module 140, a first propulsion module 141, a mid-section module 142, a second propulsion module 143, and a tail module 144. In addition, the body 110 can be segmented into several sections associated with the various modular components that form the UUV 100. The UUV 100 can be created or modified to include desired features of a particular module. For example, a nose module can be selected based on a desired sensor, warhead, and/or other payload for a particular application or mission. In another example, a mid-section module can be selected based on battery capacity, such as a greater capacity needed for a longer duration mission. In yet another example, a propulsion module can be selected based on the number of thrusters contained within the module for enhanced speed or control of the UUV. In one aspect, additional propulsion modules can be selected to provide additional thruster locations to facilitate better control or maneuverability of the UUV. For example, a tail module can be configured as a propulsion module with any suitable type of propulsion system to provide additional thrust and/or control of the UUV. In addition, some modules can be equipped with different fiber optic packages having different interfaces for a particular compatibility with another module or external device. Other types of modules and their locations within a given UUV will be apparent to those skilled in the art.

Figure 4:
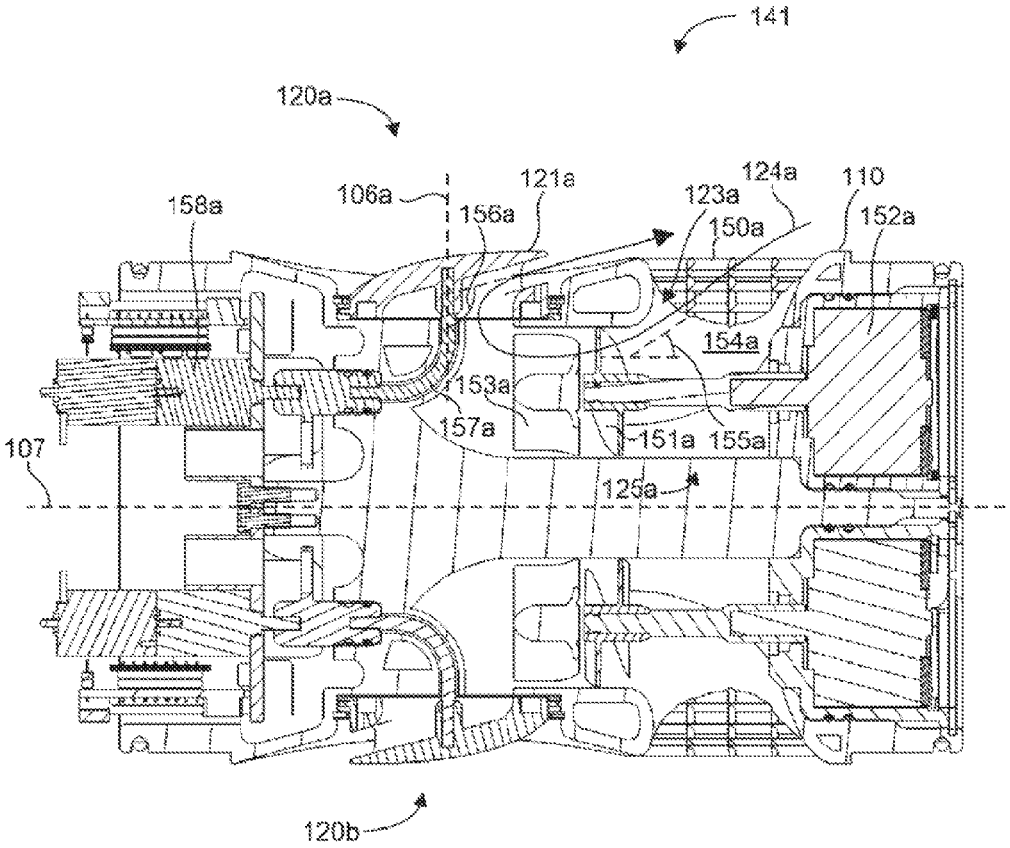
FIG. 4 is a cross-sectional view of the propulsion module of FIG. 3.
Figure 5B:
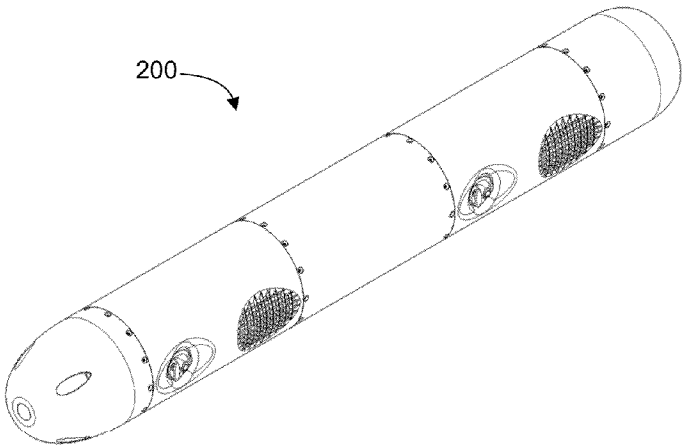
FIG. 5B is a rear perspective view of the UUV of FIG. 5A.
Figure 5A:
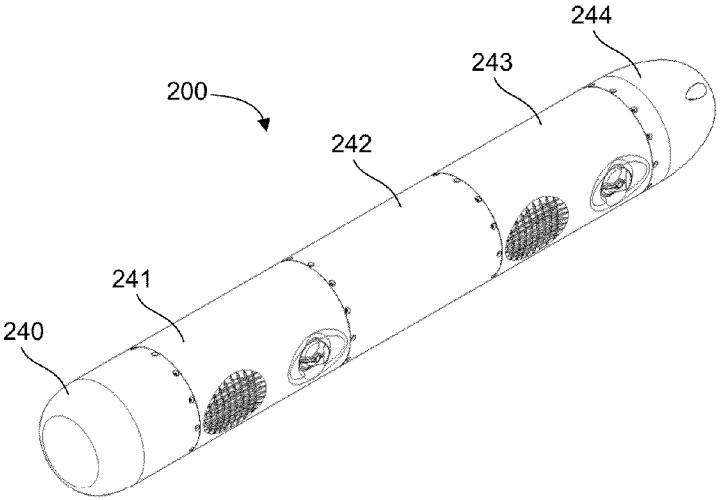
FIG. 5A is a front perspective view of a UUV in accordance with another embodiment of the present invention.

One example of a propulsion module 141 is shown in FIGS. 3 and 4, which includes two thrusters 120*a-b* of a propulsion system. In general, the thrusters 120*a-b* are flush-mounted to the body 110 and housed internally to the body 110 such that the thrusters 120*a-b* are contained substantially within an outer diameter or surface profile or envelope boundary of the body 110. As a result, there are no protruding components or exposed propeller blades.

Using thruster 120*a* as an example, a propulsion system can include an inlet 122*a* formed in the body 110 that facilitates fluid being drawn into the UUV 100 from the surrounding fluid outside the body 110. The structure forming the inlet 125*a* can be configured to maintain the outer surface profile of the body 110 for one or more purposes, such as to facilitate disposing the UUV 100 in a launch tube. In one aspect, a grate cover 150*a* can be disposed proximate to the inlet 122*a* to prevent items from entering the propulsion system 120*a* while allowing fluid to flow through the grate cover 150*a* into the duct 123*a*.

The thruster 120*a* of the propulsion system can also include a duct 123*a* in fluid communication with the inlet 122*a*, adapted to direct the fluid along a flow path 124*a*. In one aspect, the duct 123*a* can comprise an intake body 154*a* adjacent the inlet 122*a* disposed at an angle 155*a* relative to the longitudinal axis 107 of the body 110. In a particular aspect, the angle 155*a* is between about 5 degrees and about 90 degrees. In a more particular aspect, the angle 155*a* is between about 25 degrees and about 35 degrees.

The thruster 120*a* of the propulsion system can include an internal pump 125*a* operable with the duct 123*a* to control the flow of fluid within the duct, such as to facilitate active flow of the fluid along the flow path 124*a* toward the nozzle 121*a*. In one aspect, the pump 125*a* can include an impeller 151*a* driven by a motor 152*a* located outside the duct 123*a* that can increase the velocity of the fluid upon entering the duct. The pump motor 152*a* can be of any suitable type and can be controlled by a control system to increase or decrease the rotational speed of the impeller 151*a*. It should be recognized that any suitable type of pump or means for accelerating fluid may be used. The nozzle 121*a* can be in fluid communication with the duct 123*a* to receive the fluid at the increased velocity. In one aspect, a stator 153*a* can be configured as a vane to guide fluid exiting the pump 125*a*, for example, to straighten the flow of the fluid.

The nozzle 121*a* can be supported about a side of the body 110, and adapted to moveably redirect fluid out of the UUV 100, such as by rotation about axis 106*a*, which can include full 360 degree rotation about the axis 106*a*. The nozzle 121*a* can be rotatably supported about the body, and rotated by a shaft 157*a*, such as a flexible shaft, which is driven by a motor 158*a*. The nozzle motor 158*a* can be of any suitable type and can be controlled by a control system to vary the orientation of the nozzle 121*a*. It should be recognized that any suitable type of nozzle configuration for discharging fluid may be used. In one aspect, the nozzle 121*a* can discharge fluid at a discharge angle 156*a* relative to the nozzle rotation axis 106*a*. In a particular aspect, the discharge angle 156*a* can be between about 95 degrees and about 135 degrees. In a more particular aspect, the discharge angle 156*a* can be between about 100 degrees and about 115 degrees. In another aspect, the nozzle can be configured to vary the discharge angle, for example, dynamically and during operation of the UUV. The rotary nozzle 121*a* can therefore be termed a "vectoring nozzle" that moves to direct thrust. Likewise, the propulsion system 120*a* having vectoring nozzles can be termed a "vector thrust propulsion system" that can provide precise directional thrust control for the UUV 100.

In operation, the propulsion system draws water into the inlet 122*a* from outside the UUV 100 and routes it through a ducted fluid path and pump 125*a*, where the fluid is expelled through the nozzle 121*a* to provide thrust or propulsion for the UUV 100. The speed of the pump 125*a* and the orientation of the nozzle 121*a* can be controlled in concert to maneuver the UUV 100. The propulsion system can further comprise a second thruster 120*b*, substantially similar to the first thruster 120*a*. In one aspect, the thrusters 120*a-b* can be configured to fit side by side within the body 110. Operation of the first and second thrusters 120*a-b* can therefore be coordinated to maneuver the UUV 100 and enhance multi-axis control of the UUV 100. Coordinated operation of additional thrusters can be used to even further enhance multi-axis control of the UUV 100. Additionally, the internal nature of the thruster 120*a* with the concealed blades of the impeller 151*a*, as well as the grate cover 150*a*, can reduce the likelihood of entanglement with communication lines or other fouling of the pump 125*a*.

Figure 6:
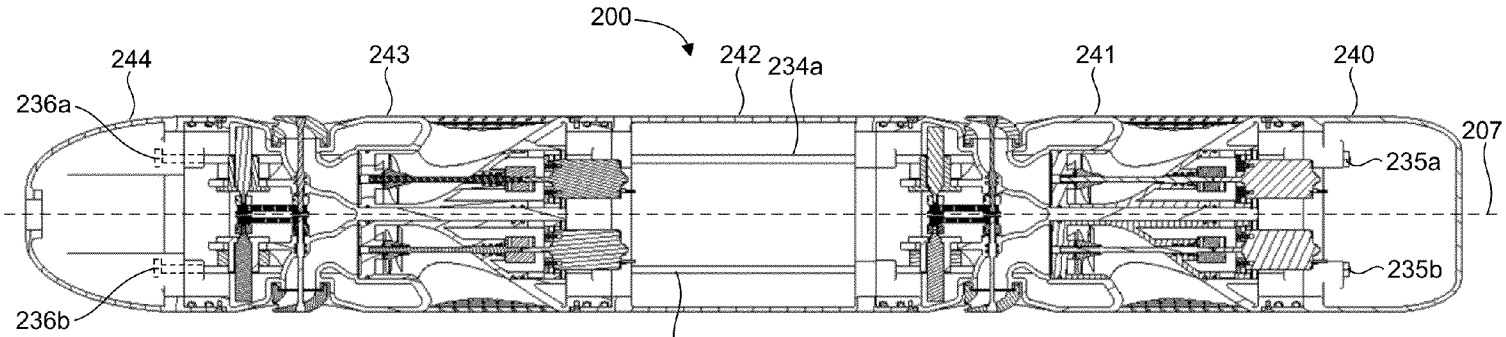
FIG. 6 is a cross-sectional view of the UUV of FIG. 5A.
Figure 7:
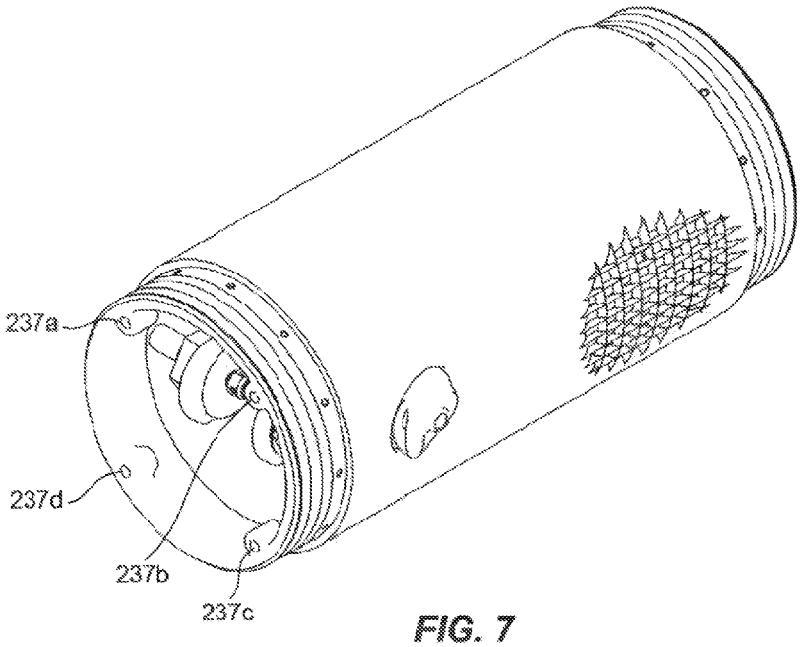
FIG. 7 is an example illustration of a propulsion module of the UUV of FIG. 5A.
Figure 8:
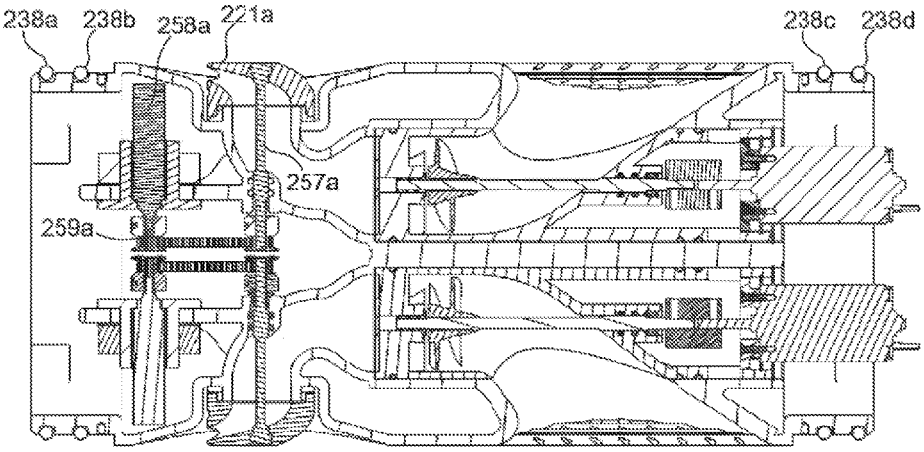
FIG. 8 is a cross-sectional view of the propulsion module of FIG. 7.

Another embodiment of a UUV 200 and associated components is illustrated in FIGS. 5A-8. The UUV 200 is similar to the UUV 100 discussed above in many respects. FIG. 6 more clearly illustrates one or more tie rods 234*a-b* extending parallel to the longitudinal axis 207 of the body 210 to secure the modular components 240-244 of the UUV 200 to one another. The tie rods 234*a-b* can be anchored on either end at locations 235*a-b* and 236*a-b* of the nose module 240 and tail module 244, respectively. It should be recognized that any suitable number of ties rods may be used. As shown in FIG. 7, each of the modules 240-244 can include one or more bosses 237*a-d* disposed on opposite ends of the respective module through which the tie rods pass to secure the tie rods to the modules 240-244. Adjacent modules, such as modules 241 and 242, can have ends configured to interlock with one another. FIG. 8 illustrates seals 238*a-d*, such as o-rings, configured to seal the interlocking junctions between adjacent modules.

In addition, FIG. 8 illustrates another example of a nozzle drive configuration. In this example, nozzle 221*a* can be rotated by a rigid shaft 257*a*, which is driven by a motor 258*a* via a drive belt 259*a* or chain. It should therefore be recognized that any suitable drive train, including features such as gears or viscous couplings, may be used to transfer torque from a nozzle motor to the nozzle to cause rotation of the nozzle.

Although the UUV 100 and the UUV 200 are shown and described herein as having a modular construction, it should be understood that a UUV in accordance with the present disclosure can be constructed in any suitable manner and need not be modular or include modular components. In particular, a UUV can include a propulsion system and associated elements and components, as described herein, regardless of the modularity, or lack thereof, of the UUV.

Figure 9A:
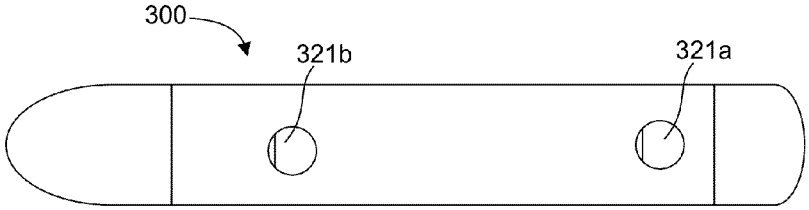
FIG. 9A is a side view of a UUV in accordance with yet another embodiment of the present invention.
Figure 9B:
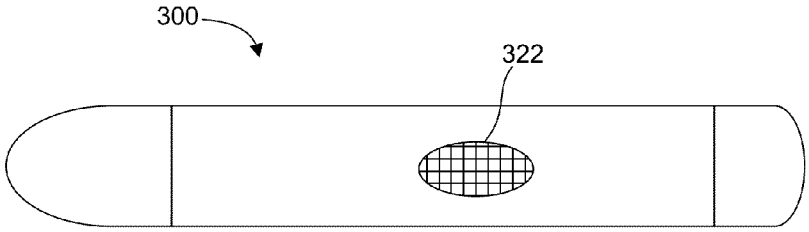
FIG. 9B is a bottom view of the UUV of FIG. 9A.

An additional embodiment of a UUV 300 is shown in FIGS. 9A and 9B. This embodiment illustrates a propulsion system in which multiple nozzles 321*a-b* are fluidly coupled to the same inlet 322, which in this case is disposed on a different side from the nozzles 321*a-b*. For example, the nozzles 321*a-d* can be on a side of the UUV 300 and the inlet 322 can be on a bottom of the UUV 300.

Figure 10:
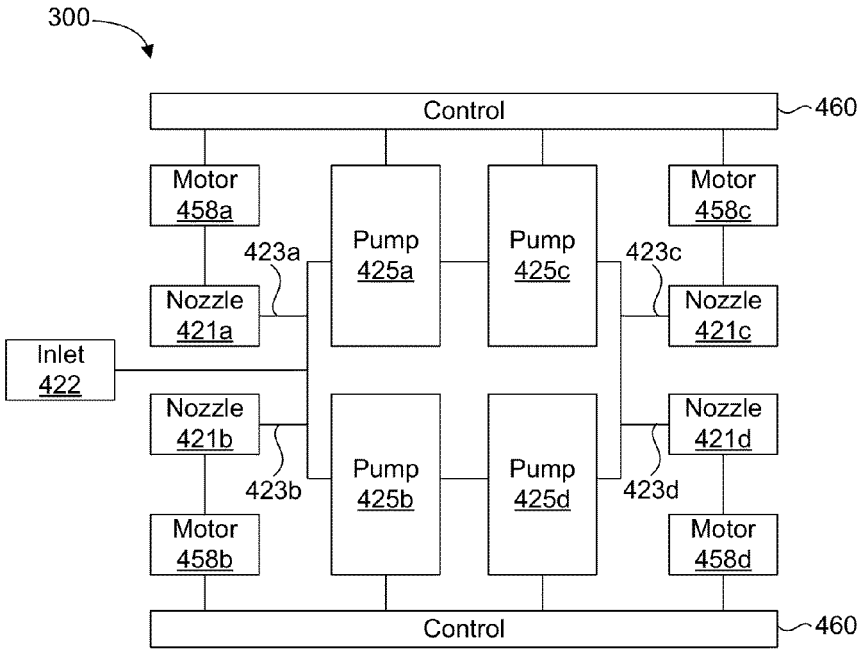
FIG. 10 is an example of a schematic diagram of a propulsion system in accordance with an embodiment of the present invention.

As schematically illustrated in FIG. 10, a propulsion system 420 can include multiple ducts 423*a-d* in fluid communication with an inlet 422, with each duct being adapted to direct fluid along a different flow path. Multiple pumps, 425*a-d*, which can include impellers 451*a-d* and motors 452*a-d*, can be operable with respective ducts 423*a-d* to increase velocity of the fluid in the ducts 423*a-d*. Nozzles 421*a-d* in fluid communication with the ducts 423*a-d* can receive the fluid at increased velocity and can be configured to moveably redirect fluid out of the UUV.

In accordance with one embodiment of the present invention, a method of controlling a UUV is disclosed. The method can comprise obtaining a UUV having a body and a propulsion system with at least two nozzles supported about opposing sides of the body. Additionally, the method can comprise coordinating control of the nozzles for multi-axis control of the UUV. In one aspect, coordinating control of the nozzles can comprise at least one of coordinating a velocity of the fluid through the nozzles and coordinating an orientation of the nozzles. It is noted that no specific order is required in this method, though generally in one embodiment, these method steps can be carried out sequentially.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. An unmanned underwater vehicle (UUV), comprising:
a body having an outer profile; and
a propulsion system for propelling and orienting the UUV, the propulsion system comprising:
an inlet formed in the body that facilitates fluid being drawn into the UUV from outside the body,
a duct in fluid communication with the inlet, the duct being adapted to direct the fluid along a flow path,
a pump operable with the duct to increase the velocity of the fluid, and
a nozzle in fluid communication with the duct to receive the fluid at the increased velocity, the nozzle being supported about a side of the body, and adapted to moveably redirect fluid out of the UUV, wherein the nozzle rotates about an axis substantially perpendicular to a longitudinal axis of the body, and
wherein the propulsion system provides multi-axis control of the UUV while remaining within the outer profile of the body.

2. The UUV of claim 1, wherein the pump comprises an impeller.

3. The UUV of claim 1, wherein the nozzle is countersunk below the outer profile of the body.

4. The UUV of claim 1, wherein the duct comprises an intake body adjacent the inlet disposed at an angle between about 5 degrees and about 90 degrees relative to a longitudinal axis of the body.

5. The UUV of claim 4, wherein the intake body is disposed at an angle between about 25 degrees and about 35 degrees relative to a longitudinal axis of the body.

6. The UUV of claim 1, wherein the nozzle discharge angle is between about 95 degrees and about 135 degrees relative to the nozzle rotation axis.

7. The UUV of claim 6, wherein the nozzle discharge angle is between about 100 degrees and about 115 degrees relative to the nozzle rotation axis.

8. The UUV of claim 1, further comprising a stator configured as a vane to guide fluid exiting the pump.

9. The UUV of claim 1, further comprising a grate cover disposed proximate to the inlet to prevent items from entering the propulsion system while allowing fluid to flow through.

10. The UUV of claim 1, further comprising a second propulsion system to enhance control of the UUV.

11. The UUV of claim 10, wherein the nozzles of the first and second propulsion systems are supported about opposite sides of the body from one another.

12. The UUV of claim 1, wherein the propulsion system further comprises:
a second duct in fluid communication with the inlet, the second duct being adapted to direct the fluid along a second flow path;
a second pump operable with the second duct to increase the velocity of the fluid; and
a second nozzle in fluid communication with the second duct to receive the fluid at the increased velocity, the second nozzle being adapted to moveably redirect fluid out of the UUV.

13. The UUV of claim 12, wherein the first nozzle and the second nozzle are supported about opposite sides of the body from one another.

14. The UUV of claim 1, wherein the body is segmented into modular components, with one of the modular components comprising the propulsion system to form a propulsion module.

15. The UUV of claim 14, wherein one of the modular components comprises a second propulsion system to form a second propulsion module.

16. The UUV of claim 14, further comprising a tie rod extending parallel to a longitudinal axis of the body to secure the modular components to one another.

17. An unmanned underwater vehicle (UUV), comprising:
a body having an outer profile; and
a pair of thrusters for propelling and orienting the UUV, each thruster comprising:
an inlet formed in the body that facilitates fluid being drawn into the UUV from outside the body,
a duct in fluid communication with the inlet, the duct being adapted to direct the fluid along a flow path,
a pump operable with the duct to increase the velocity of the fluid, and
a nozzle in fluid communication with the duct to receive the fluid at the increased velocity, the nozzle being adapted to moveably redirect fluid out of the UUV, wherein the nozzle rotates about an axis substantially perpendicular to a longitudinal axis of the body, and
wherein the nozzles are supported about opposite sides of the body to provide multi-axis control of the UUV while remaining within the outer profile of the body.

18. The UUV of claim 17, further comprising a second pair of thrusters having nozzles supported on opposite sides of the body from one another, wherein the first pair of thrusters is disposed at a forward end of the UUV and the second pair of thrusters is disposed at a rearward end of the UUV.

19. A method of controlling an unmanned underwater vehicle (UUV), comprising:
obtaining a UUV including
a body having an outer profile, and
a propulsion system for propelling and orienting the UUV, the propulsion system having
an inlet formed in the body that facilitates fluid being drawn into the UUV from outside the body,
a duct in fluid communication with the inlet, the duct being adapted to direct the fluid along a flow path,
a pump operable with the duct to increase the velocity of the fluid, and
a nozzle in fluid communication with the duct to receive the fluid at the increased velocity, the nozzle being supported about a side of the body, and adapted to moveably redirect fluid out of the UUV, wherein the nozzle rotates about an axis substantially perpendicular to a longitudinal axis of the body, and wherein the propulsion system is configured to provide multi-axis control of the UUV while remaining within the outer profile of the body; and coordinating control of the propulsion system for multi-axis control of the UUV.

20. The method of claim 19, wherein coordinating control of the propulsion system comprises at least one of coordinating a velocity of the fluid through the nozzles and coordinating an orientation of the nozzles.

* * * * *